United States Patent [19]

Willcocks

[11] 4,331,333

[45] May 25, 1982

[54] APPARATUS AND METHOD FOR PLAYING A BOARD GAME

[76] Inventor: Martin E. G. Willcocks, P.O. Box 1688, Santa Monica, Calif. 90406

[21] Appl. No.: 813,504

[22] Filed: Jul. 7, 1977

[30] Foreign Application Priority Data

Jul. 9, 1976 [GB] United Kingdom ..... 28690/76

[51] Int. Cl.[3] ..... A63F 3/00

[52] U.S. Cl. ..... 273/238; 273/239; 273/282; 273/288; 273/272; 273/283; 273/249

[58] Field of Search ..... 273/238, 239, 242, 248, 273/275, 272, 249, 282, 283, 288

[56] References Cited

U.S. PATENT DOCUMENTS

| | | | |
|---|---|---|---|
| 1,591,639 | 7/1926 | McDonald | 273/242 |
| 2,585,268 | 2/1952 | Olsen | 273/275 X |
| 3,075,771 | 1/1963 | Dodge | 273/275 |
| 3,309,092 | 3/1967 | Hardesty et al. | 273/275 X |
| 3,406,974 | 10/1968 | Nelson | 273/248 X |
| 3,481,604 | 12/1969 | Fan | 273/238 |
| 3,680,865 | 8/1972 | Davis | 273/239 |
| 3,697,076 | 10/1972 | Yogel | 273/238 |
| 3,820,791 | 6/1974 | Powers | 273/275 X |
| 4,021,042 | 5/1977 | Sweeton | 273/239 |

*Primary Examiner*—Richard C. Pinkham
*Assistant Examiner*—Harry Strappello

[57] ABSTRACT

The game comprises a tray containing a plurality of removable tiles which may be arbitrarily placed in the tray. Two players are each provided with individual pieces which can be placed on tiles after the tiles have been arbitrarily placed in the tray. Each player takes a turn in moving one of his pieces from one tile to a next adjacent tile. The first move of each player is arbitrary as to which adjacent tile is chosen to move his piece. The second move of each player and every alternate move thereafter is a "forced" move determined by a direction resulting when the piece is placed on the tile. In other words, each tile has an assigned direction which is hidden from the player but which becomes indicated when the player places his piece on the tile. The players alternate turns and attempt to reach a center tile which constitutes a winning point.

23 Claims, 30 Drawing Figures

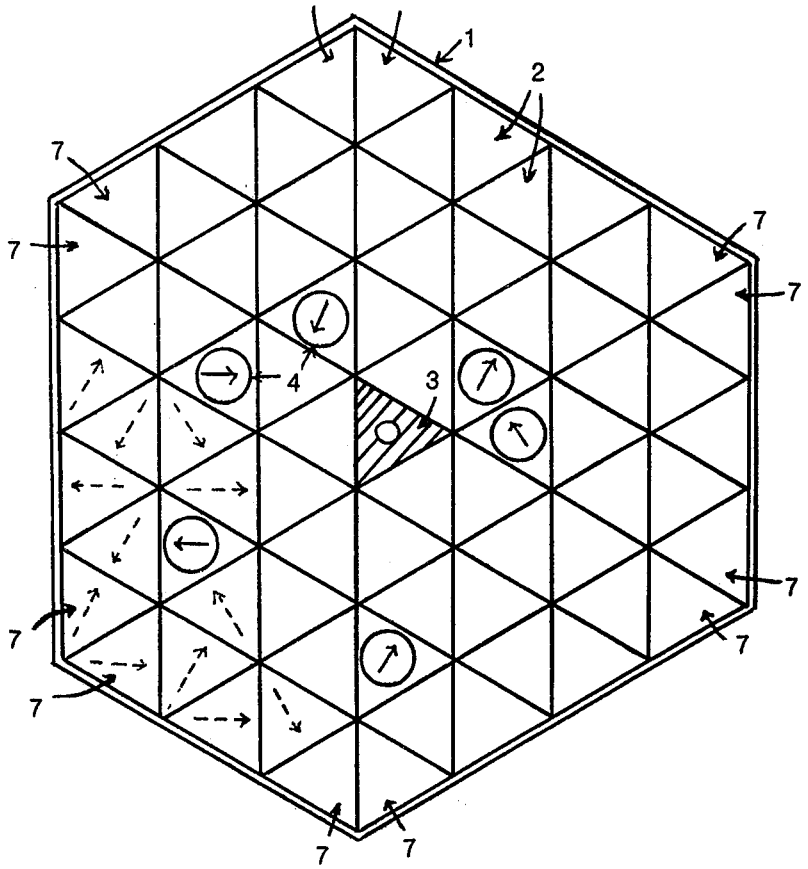
FIG. 2
FIG. 17
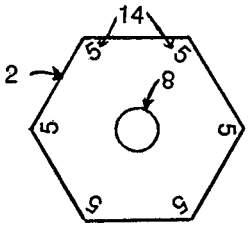
FIG. 18
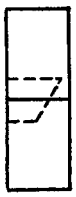
FIG. 19
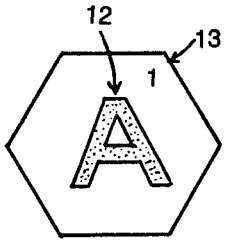

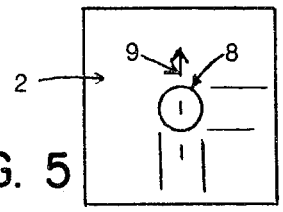
FIG. 5
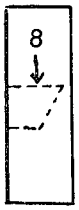
FIG. 6
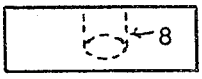
FIG. 7
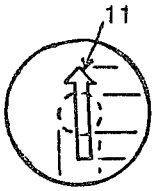
FIG. 8
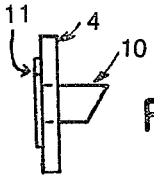
FIG. 9
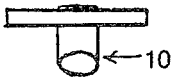
FIG. 10
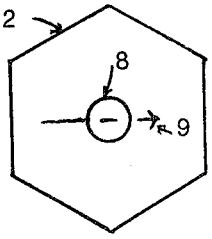
FIG. 11
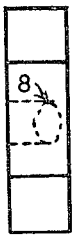
FIG. 12
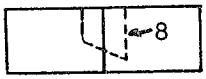
FIG. 13
FIG. 14
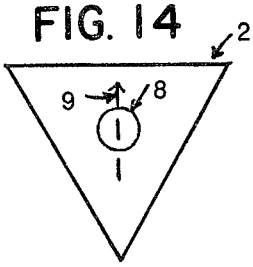
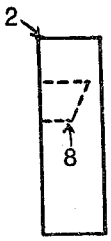
FIG. 15
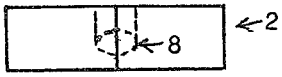
FIG. 16

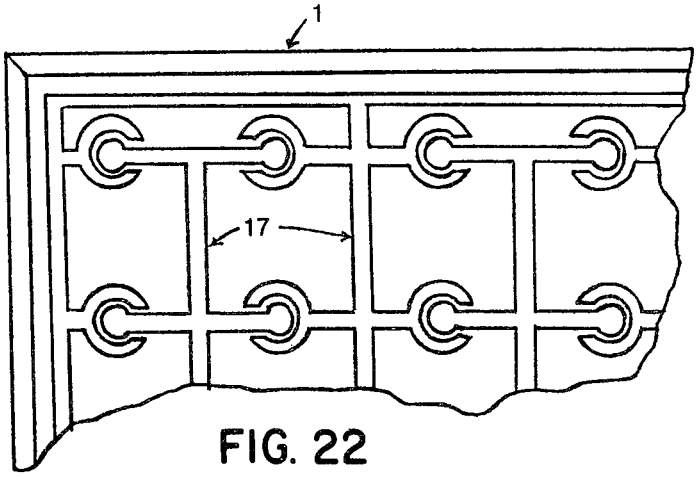
FIG. 22
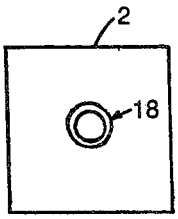
FIG. 23
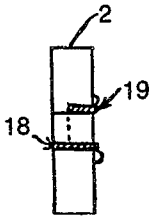
FIG. 24
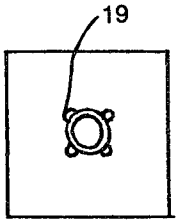
FIG. 25
FIG. 26
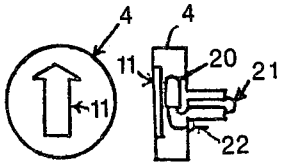
FIG. 27
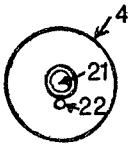
FIG. 28
FIG. 29
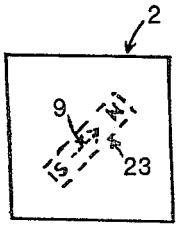
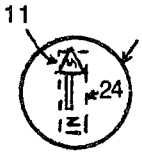
FIG. 30

APPARATUS AND METHOD FOR PLAYING A BOARD GAME

This invention relates to apparatus and methods for playing a board game. The game is played with pieces upon a board consisting of a tray of specified shape containing a plurality of tiles sufficient to fill the said tray. Each such tile has assigned to it a unique direction, and is so contrived that the said direction can be determined when a piece is placed thereon but not otherwise, and each such tile can be fitted in the tray in a plurality of different positions, and can assume any of a number of possible orientations when fitted in any particular position.

Each of the said pieces is identifiable by means of a mark or colour, and is capable of being placed upon any of the said tiles, thereupon indicating by means of an arrow or otherwise the unique direction assigned to the tile upon which it rests.

METHOD OF PLAY

The general method of playing the game is the following. Initially, each player is given a specified number of pieces, his pieces being identified by a mark or colour so as to distinguish them from those of any other player. The said tray is filled with the said tiles in a random manner such that the direction assigned to any of the tiles thereon cannot be determined except by placing pieces thereon in the course of play, the said tiles being undisturbed thereafter until the end of the game. The centre of the tray is designated as the finishing position for all players, and a starting position is designated for each of the players.

The players draw lots or otherwise determine who shall start the game. Play proceeds clockwise round the board from the first player to the last player, and a round of play is completed when the last player has completed his turn.

To commence play, the first player places one of his pieces on the tile at his designated starting position and moves it to an immediately adjacent tile in any direction he chooses. Each of the players in turn similarly places one of his pieces on the tile at his designated starting position and moves it to an immediately adjacent tile in any direction he chooses. When the last player has completed his turn, the first round is complete.

In the second round, each player in turn must move his piece to the immediately adjacent tile in the direction indicated by the arrow on his piece (or by such other method as is used to determine the direction assigned to the tile on which his piece rests). If the indicated move is such that his piece will leave the board, he must remove it from the board and discard it in the losing discard pool, and it remains out of play until the end of the game. If the indicated move is such that his piece will land on a tile occupied by another piece he removes the other piece, discarding it in the losing discard pool, and places his own piece on the tile in its stead. The piece thus removed from the board remains out of play until the end of the game. If any player's piece has been thus removed from the board and it is his turn to play, he places another of his pieces on the tile at his designated starting position and then moves it to an immediately adjacent tile in any direction he chooses. The second round of play is completed when the last player has completed his turn. A round in which each player has to move his piece in the direction assigned to the tile upon which it rests is called a forced move round.

In the third round, as in the first, each player in turn moves his piece to an immediately adjacent tile in any direction he chooses. He may not, however, move his piece off the board. If another player's piece is resting on a tile adjacent to that on which his piece rests when it is his turn to move, he may capture the piece by taking it off the board and placing his own piece in its stead, the piece taken off the board being discarded in the losing discard pool where it remains until the end of the game. If any player's piece has been thus removed from the board and it is his turn to play, he places another of his pieces on the tile at his designated starting position and then moves it to an immediately adjacent tile in any direction he chooses. The third round of play is completed when the last player has completed his turn. Such a round, in which each player has a free choice of the direction of movement of his piece, is called a free move round.

Subsequent rounds are played in like manner, forced move rounds and free move rounds being played alternately.

If at any stage of the game a player's piece lands on the centre tile of the tray, the finishing position, it is removed from the board and placed in the winning discard pool, where it remains until the end of the game. The player then places another of his pieces on the tile at his designated starting position and moves it to an immediately adjacent tile in any direction he chooses.

If at any stage of the game a player has exhausted his supply of pieces he is out of the game and play passes to the next player in turn. He may still win, however. When all the players have exhausted their supply of pieces the game is over and the player having the largest number of pieces in the winning discard pool is the winner.

Alternatively a point scoring scheme may be adopted, each player scoring points for every piece which reaches the finishing position, and for capturing other players' pieces, points being deducted for pieces captured by other players or forced to have the board.

If a point-scoring method is used, the game may alternatively end on the first occasion upon which a player's piece reaches the winning position. In this case, points may be scored for the remaining pieces on the board, depending on their closeness to the centre, or alternatively by assigning a score to each tile, which is marked thereon.

The reverse side of each tile may also bear a letter or other device and a figure representing a score, for use in a word game.

By way of example, but not by way of limitation, several possible embodiments of the invention will now be described with reference to the Figures submitted herewith.

DESCRIPTION OF THE FIGURES

FIG. 2 illustrates an embodiment of the game in which the tray is hexagonal and the tiles are all in the form of equilateral triangles;

FIG. 5 is a top plan view of a tile illustrating in detail a method whereby the unique direction assigned to any tile may be indicated by a piece placed thereon;

FIG. 6 is a side elevation of the tile of FIG. 5;

FIG. 7 is another side elevation of the tile of FIG. 5 at 90° to the side elevation illustrated in FIG. 6;

FIG. 8 is a top plan view of a piece utilized with the tile of FIG. 5;

FIG. 9 is a side elevational view of the piece of FIG. 8;

FIG. 10 is another side elevational view of the piece of FIG. 8 taken 90° from the side view of FIG. 9;

FIG. 11 is a plan view of an hexagonal shape tile incorporating the method illustrated in FIGS. 5, 6 and 7;

FIG. 12 is a side elevation of the tile of FIG. 11;

FIG. 13 is another side elevation of the tile of FIG. 11 taken at 90° to that of FIG. 12;

FIG. 14 is a plan view of a triangular shaped tile utilizing the method of FIGS. 5, 6 and 7;

FIG. 15 is a side elevation of the tile of FIG. 14;

FIG. 16 is another side elevation of the tile 14 taken at 90° to that of FIG. 15;

FIG. 17 is a top plan view of a hexagonal tile bearing a score and so constructed that it can also be used in a word game;

FIG. 18 is a side elevational view of the tile of FIG. 17;

FIG. 19 is a bottom plan view of the tile of FIG. 17;

FIG. 22 is a fragmentary top plan view of a portion of a tray incorporating a printed circuit;

FIG. 23 is a top plan view of a square tile to be used with the tray of FIG. 22;

FIG. 24 is a side elevation partly in cross section of the tile shown in FIG. 23;

FIG. 25 is a bottom plan view of the tile shown in FIG. 3;

FIG. 26 is a top plan view of a piece to be played on the tile such as illustrated in FIG. 23;

FIG. 27 is a side view partly in cross section of the piece shown in FIG. 26;

FIG. 28 is a bottom plan view of the piece shown in FIG. 26;

FIG. 29 is a top plan view of a square tile illustrating a magnet embedded therein; and, FIG. 30 is a top plan view of a piece illustrating another magnet embedded therein for cooperation with the tile shown in FIG. 29.

PREFERRED EMBODIMENTS OF THE INVENTION

Figure 1:
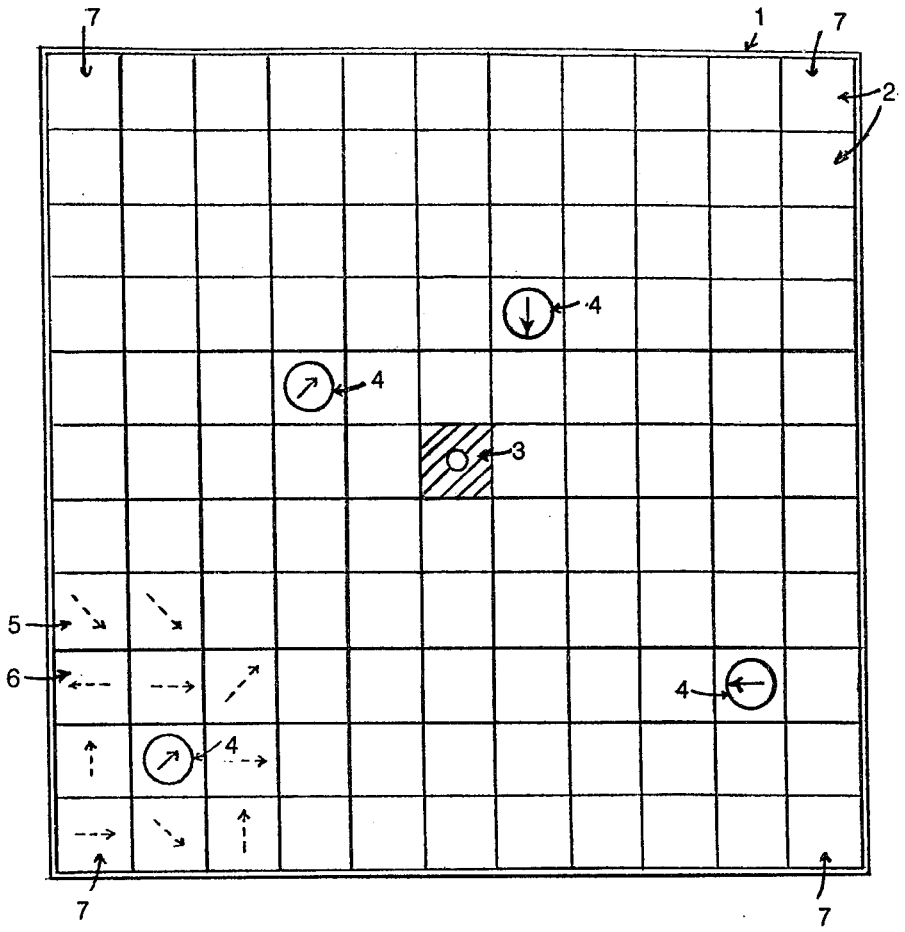
FIG. 1 illustrates an embodiment of the game in which the tray is square and the tiles are all square in form.

In one embodiment of the invention, as shown in FIG. 1, the tray labelled 1 is square in shape, the tiles labelled 2 also being square, and the side of the tray being an odd multiple of the side of each tile. For example, the embodiment depicted in FIG. 1 has eleven tiles to each side of the tray.

The centre tile labelled 3 may be fixed to the tray, or may be a different colour from the other tiles, to distinguish it as the finishing position. The remaining tiles may be of two kinds, the first kind, labelled 5 in FIG. 1, having the direction assigned to it (shown by the dotted arrow) along a diagonal, and the second kind, labelled 6, having the direction assigned to it parallel to a side, neither kind of tile being distinguishable from the other in any other way. Any number of the first kind may be used in conjunction with the required number of the other kind to completely fill the tray. Since each tile is square and of equal size, it may be fitted in any of the possible locations in the tray (120 in the case of FIG. 1) and in any of four possible orientations in any position. Thus the board configuration changes from game to game in an unpredictable manner. For example, the directions assigned to some of the tiles in FIG. 1 are shown by dotted arrows.

To fill the tray, a number of tiles are placed in it and shaken about until they have filled many of the possible locations. The remaining spaces are then filled at random with tiles until the tray is filled, the centre tile (of a different colour) being finally placed in the centre (finishing) position.

Each player starts from the one of the four starting locations 7 assigned to him, and uses pieces of a different colour (or otherwise distinguished from those of the other players). Several pieces, labelled 4 are shown in FIG. 1. A particular way in which the unique direction assigned to any tile may be indicated by a piece placed thereon is illustrated in FIG. 5 and will be described later. The arrows on the pieces labelled 4 in FIG. 1 represent the directions assigned to the tiles on which they rest.

In a second embodiment of the invention, shown in FIG. 2, the tray, labelled 1, is hexagonal in shape, being designed to accept tiles in the form of equilateral triangles labelled 2, and so contrived that one tile labelled 3 occupies a central position designated as the finishing position, as depicted in FIG. 2. Starting locations are assigned for up to 12 players as indicated at 7 in FIG. 2. In this embodiment all the tiles are of one form, the direction assigned to any tile being normal to one edge of the tile. Each tile can be fitted in any of the possible locations, and in any of the three possible orientations.

Figure 3:
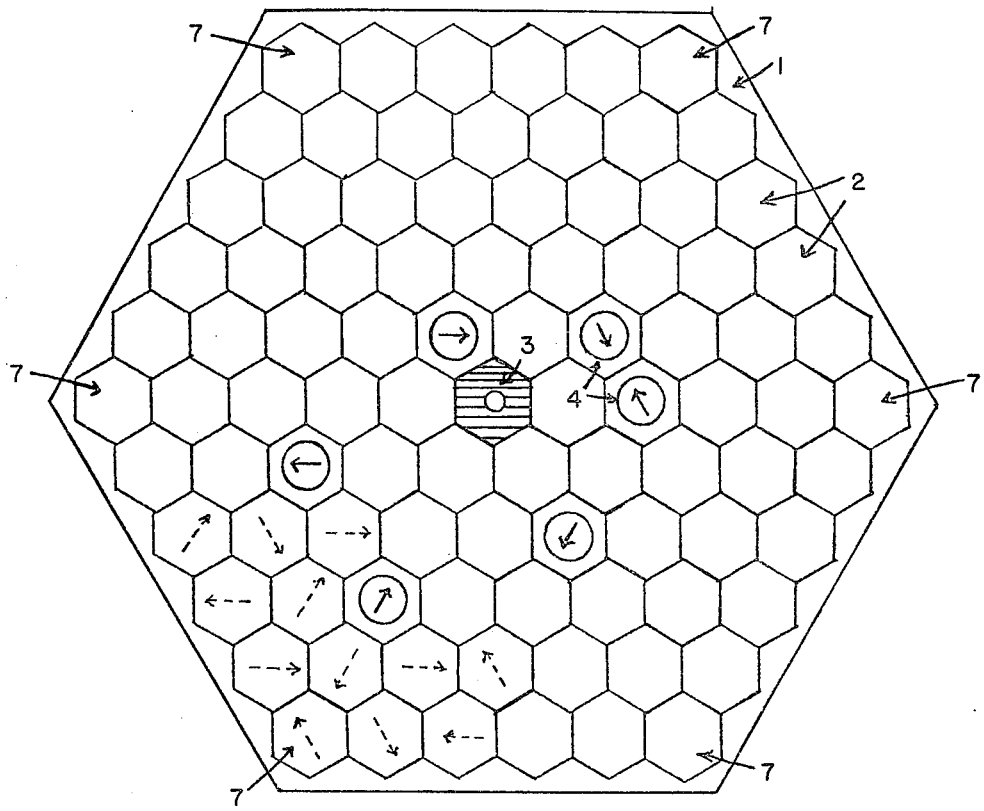
FIG. 3 illustrates an embodiment of the game in which the tray is of complex shape, having hexigonal symmetry, and the tiles are all in the form of regular hexagons.

In a third embodiment of the invention, illustrated in FIG. 3, the tray 1 is of a complex shape having hexagonal symmetry and designed to accommodate a number of hexagonal tiles, 2. There are six starting locations labelled 7 and again there is a central finishing location, 3. The direction assigned to each tile is normal to one side, and as each tile is regular it may be placed in any of the locations and in any of six possible orientations.

Figure 4:
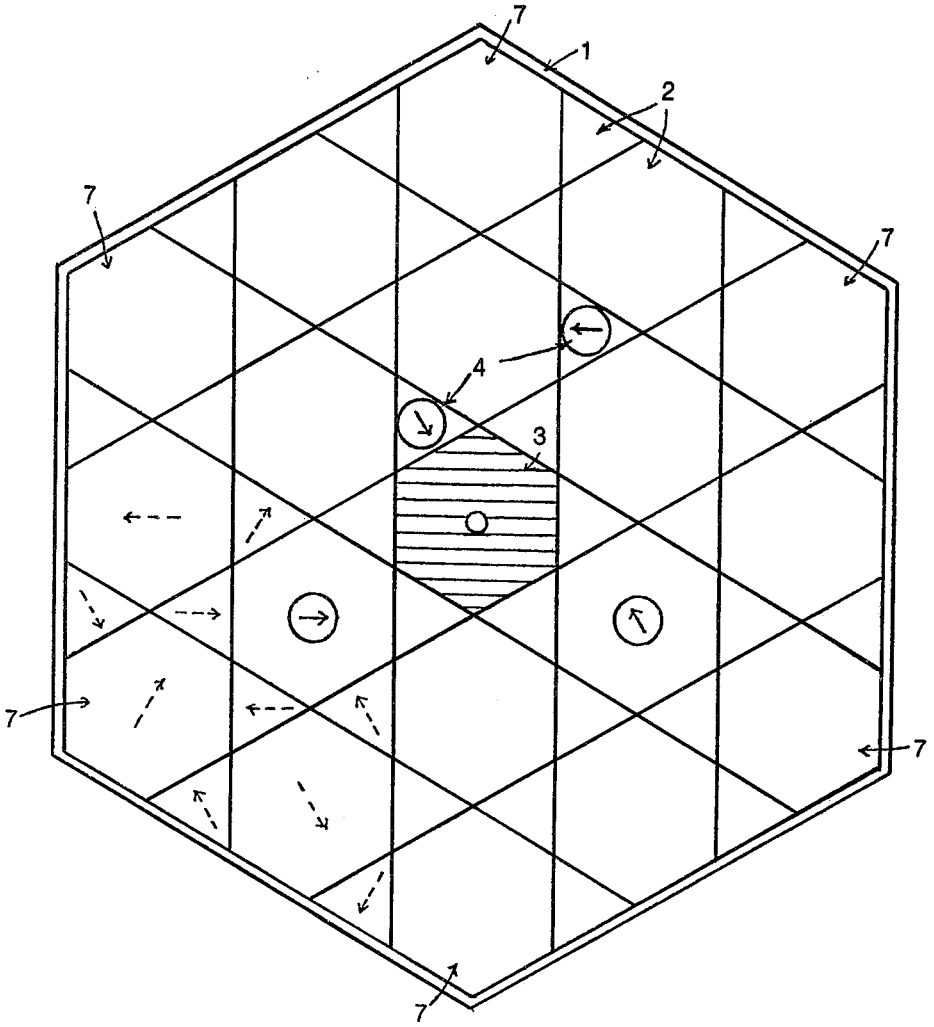
FIG. 4 illustrates an embodiment of the game in which the tray is hexagonal and the tiles are either triangular or hexagonal in form.

In a fourth embodiment of the invention, illustrated in FIG. 4, the tray 1 is of regular hexagonal shape and the tiles 2 are both hexagonal and triangular in shape. They fit into the tray in a regular array of hexagons interspersed with triangles as shown in FIG. 4. Each of the triangular pieces may be placed in any "triangular" location in any of three possible orientations and each of the hexagonal pieces may be placed in any "hexagonal" location in any of six orientations.

These examples by no means exhaust the possible configurations of the tray and tiles forming the board, and indeed any similar array of pieces of the same shape or of different shapes and sizes may be employed, provided that in principle the exact configuration of directions assigned to the tiles on the board is not known or discernible to any of the players before play commences.

FIGS. 5–16 show in detail a method of assigning an unique direction to a tile and of indicating the direction assigned to a tile when a piece is placed upon it.

In each tile 2 such as the square tile of FIG. 5, the hexagonal tile of FIG. 11 and the triangular tile of FIG. 14, there is a central blind hole, labelled 8, the blind end being at an oblique angle to the axis of the hole, as shown in FIGS. 6 and 7; 12 and 13; 15 and 16, respectively. The orientation of the deepest point of the hole defines the direction assigned to the tile, which is indicated by the dotted arrow 9 in the FIGS. 5, 11 and 14.

Each piece labelled 4, shown in FIGS. 8, 9 and 10 bears upon its underside a cylindrical stem 10 which fits loosely in the hole in the tile. The end of this stem is cut at an oblique angle to match the angle of the blind end of the hole in the tile, as shown in FIGS. 9 and 10. The top surface of the piece bears an arrow 11 as shown in FIG. 8 orientated in a fixed direction relative to the largest point of the stem. The length of the stem is such that the piece will not rest in the tile properly unless it is in the correct orientation. If the oblique cut of the stem and the oblique end of the hole are sufficiently inclined to the normals to their respective axes, the piece will turn when placed on the tile and settle with the arrow pointing in the direction assigned to the tile. Similar techniques may be applied to hexagonal and triangular tiles as shown in FIGS. 11–16.

Many other methods can also be used to assign a direction to a tile and to indicate the direction assigned thereto when a piece is placed upon it, including for example, as shown in FIGS. 22–28, methods in which the direction is indicated electrically by means of a lamp 20 or other device in the piece as shown in FIG. 27. The tray 1 of FIG. 22 is made in the form of a printed circuit board defining tracks 17, the tiles 2 bearing contacts 18, 19 as shown in FIGS. 23–25 connecting to the tracks 17 and the pieces 4 making connections 21,22 shown in FIGS. 27 and 28 between these contacts thereby completing an electrical circuit to indicate the array 11 in FIG. 26 and thus the direction assigned to the tile. Alternatively, as shown in FIGS. 29 and 30, permanent magnets 23,24 may be embedded in the tiles 2 and pieces 4 which cause the pieces to be aligned in the direction 9 assigned to the tiles beneath them.

In an alternative embodiment of the game, the reverse side of each tile such as the hexagonal tile shown in FIGS. 17 and 18, may bear a letter of the alphabet or other symbol as shown at 12 in FIG. 19 for use in a word-forming game, and a figure as shown at 13 for use in scoring and the obverse may bear figures as shown at 14 in FIG. 17 representing a score to be used in an alternative method of playing the game as has been described above. Such figures must be placed at each corner of the tile so that the direction assigned to it cannot be determined therefrom.

Figure 20:
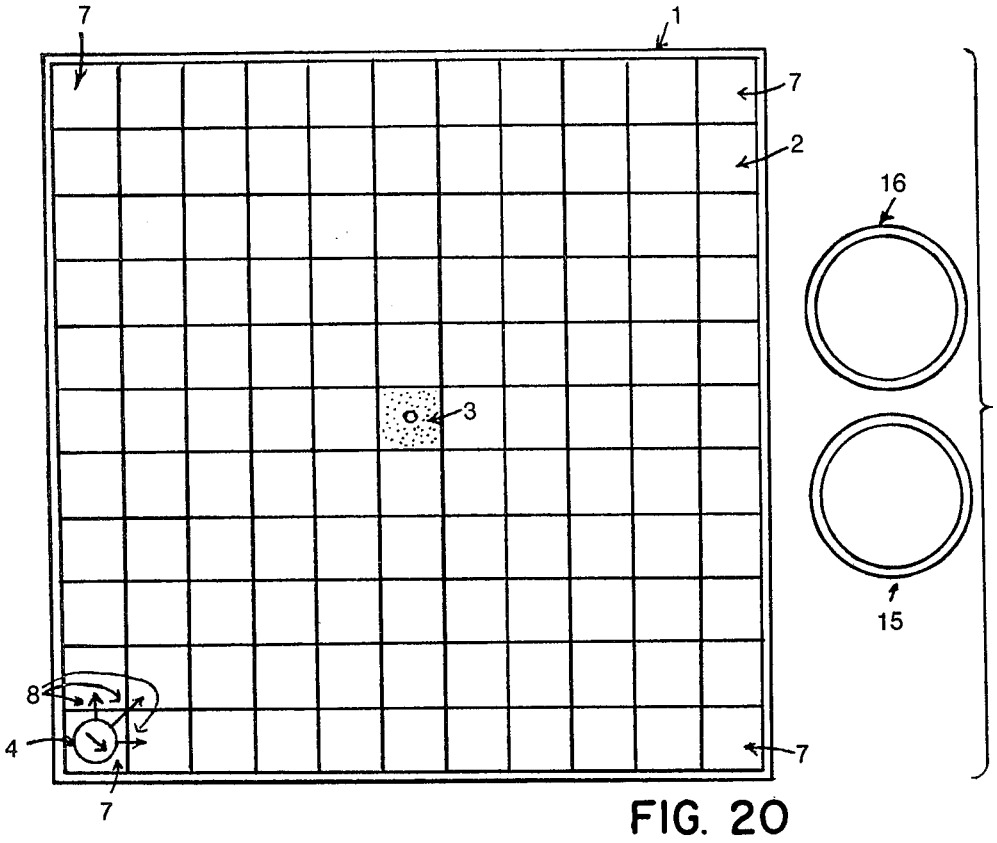
FIG. 20 is a plan view of the tray illustrating a first stage in play of the game.
Figure 21:
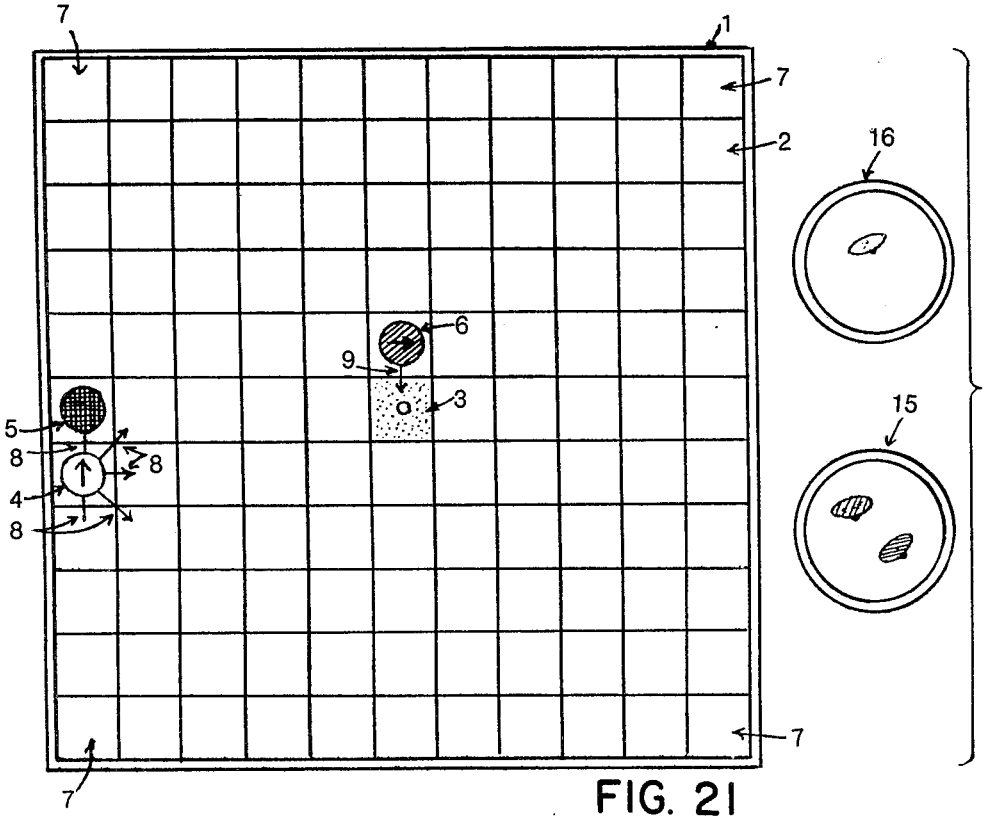
FIG. 21 is a view similar to FIG. 20 illustrating a second stage in the play of the game.

Referring now to FIGS. 20 and 21, depicting stages in playing the game, FIG. 20 depicts the board in a configuration similar to that of FIG. 1. In FIG. 20 the tray is indicated at 1, with tiles 2 placed therein, the central tile 3 being of a different colour or otherwise distinguished as the finishing point. The tiles at the corners of the tray labelled 7 are the designated starting positions, and a piece 4 is shown in place on the first starting position. The first player has a choice of directions of movement as indicated by the solid arrows towards each of the adjacent tiles.

In FIG. 21 which represents a later stage in the game, as played by three players, a piece of the first player labelled 4 is adjacent to one belonging to the second player labelled 5, while the third player has a piece labelled 6, adjacent to the finishing position. On the turn of the first player, he may either proceed in any of the directions depicted by the arrows labelled 8 around his piece if it is a free move round, or if it is a forced move round he must move in the direction of the arrow on his piece. In the latter case his piece moves to the position occupied by the piece of the second player and the latter is removed from the board and discarded into the losing discard pool, labelled 15.

If it is the second player's turn to move he may similarly move in any direction in a free move round, taking the first player's piece if he so chooses, or if it is a forced move round he must move in the direction of the arrow on his piece. Since this move is off the board, he must remove his piece from the board and place it in the losing discard pool, labelled 15.

If it is the third player's turn to move and he has a free choice, he moves in the direction indicated by arrow 9 to land on the finishing tile. Thereupon, he discards the piece and places it in the winning discard pool 16. He then takes a new piece from his stock of pieces and places it in his designated starting position, and moves it to any of the adjacent tiles in any chosen direction.

In FIG. 21 if it is player 3's turn to move and he is able to move his piece to the finishing point as described above, in the alternative method of play in which points are scored, on completion of player 3's move the game is ended. Player 3 scores points for reaching the finish, while players 1 and 2 score points respectively as indicated in the manner of FIG. 17 on the tiles on which their pieces are resting. These points are added to their previous scores and the player with the highest score wins.

Numerous other variations of the method of play can be devised using this apparatus, for example each player may start with several or all of his pieces at specified locations on the board, capturing of pieces may be prohibited; players may be forced to lose a turn instead of capturing a piece or moving off the board, etc. However, the principle of the game is as exemplified above, in that the configuration of the directions assigned to the tiles forming the board is indeterminate before play commences, and the direction assigned to any tile can only be determined by placing a piece thereon in the course of play and furthermore, free move rounds and forces move rounds occur at various stages of the game, each player's pieces attempting to move from a designated starting location to arrive at a finishing location. If more than one piece per player is allowed on the board at any time, the players may have a choice of moving any one of their pieces, but the directions of movement may be either freely chosen or forced by the arrows thereon.

What I claim is:

1. Apparatus for playing a game comprising a tray of specified shape for containing tiles, a plurality of tiles of specified shapes and of one or more kinds, so constructed that they fit into said tray to fill it completely with a single layer of said tiles, each of said tiles having assigned to it an unique direction of movement which cannot be readily determined without external means therefor, each of said tiles being capable of being placed in more than one position within the said tray and of assuming more than one possible orientation at any such position, said tiles fitted into said tray comprising the board for said game, certain of said tiles being designated as starting positions for each of the players and a certain one or certain ones of said tiles being designated as the finishing position for all players or as finishing positions for each of the players, and a plurality of pieces for play, each of said pieces being identifiable by a mark or color, and each containing means for determining and indicating the unique direction of movement assigned to any tile upon which it is placed, several pieces of each of a number of colors being provided.

2. Apparatus according to claim 1 wherein each of said tiles is assigned an unique direction of movement by means of a central vertical blind cylindrical hole the blind end of which is oblique and is so oriented that its deepest point lies in the assigned direction relative to the axis of said hole, and wherein said means for determining said unique direction of movement contained by each of said pieces comprises a cylindrical stem attached to the underside of each piece, having an oblique end and so constructed that when any of said pieces is placed upon any of said tiles with said stem fitted into the hole therein, it will rotate freely until the oblique end of said stem is in contact with the oblique end of said hole, and wherein said means for indicating the unique direction of movement thus determined comprises means upon the visible surface of said piece.

3. Apparatus according to claim 2 wherein each of said tiles is of regular polygonal shape and said tray is symmetrical, and wherein said pieces are circular.

4. Apparatus according to claim 3 wherein said tray is square in form and each of said tiles is also square, the length of the side of said tray being a multiple of the length of the side of each tile, all tiles being of the same size, and wherein some or all of said tiles may be assigned a direction of movement parallel to one side, the remainder of said tiles being assigned a direction of movement along a diagonal, the total number of said tiles being sufficient to fill said tray.

5. Apparatus according to claim 3 wherein said tray is of regular hexagonal form and some of said tiles are triangular and some are hexagonal, the length of the sides of the triangular and hexagonal tiles being equal and the numbers of each type being sufficient to fill the tray in a regular array wherein hexagonal and triangular tiles are juxtaposed, the direction of movement assigned to each tile being normal to one side of said tile,

6. Apparatus according to claim 3 wherein said tray is of irregular hexagonal form and each of said tiles is an equilateral triangle, the direction of movement assigned to said tile being normal to one side.

7. Apparatus according to claim 3 wherein said tray is of hexagonal symmetry and each of said tiles is a regular hexagon, the direction of movement assigned to said tile being normal to one side.

8. Apparatus according to claim 1 wherein each of said tiles is assigned an unique direction by means of a permanent magnet totally contained therein and magnetised in the assigned direction, and wherein said means for determining said unique direction of movement consists of another permanent magnet attached to or contained in or comprising each of said pieces so that when any of said pieces is placed upon any of said tiles it will rotate under magnetic attraction to the orientation so determined, and wherein said means of indicating the unique direction of movement thus determined comprises means upon the visible surface of said piece.

9. Apparatus according to claim 8 wherein each of said tiles is of regular polygonal form and said tray is symmetrical, and wherein said pieces are circular.

10. Apparatus according to claim 9 wherein said tray is square in form and each of said tiles is also square, the length of the side of said tray being a multiple of the length of the side of each tile, all tiles being of the same size, and wherein some or all of said tiles may be assigned a direction of movement parallel to one side, the remainder of said tiles being assigned a direction of movement along a diagonal, the total number of said tiles being sufficient to fill said tray.

11. Apparatus according to claim 9 wherein said tray is of regular hexagonal form and some of said tiles are triangular and some are hexagonal, the length of the sides of the triangular and hexagonal tiles being equal and the numbers of each type being sufficient to fill the tray in a regular array wherein hexagonal and triangular tiles are juxtaposed, the direction of movement assigned to each tile being normal to one side of said tile.

12. Apparatus according to claim 9 wherein said tray is of irregular hexagonal form and each of said tiles is an equilateral triangle, the direction of movement assigned to said tile being normal to one side.

13. Apparatus according to claim 9 wherein said tray is of hexagonal symmetry and each of said tiles is a regular hexagon, the direction of movement assigned to said tile being normal to one side.

14. Apparatus according to claim 1 wherein said tray consists of an electrically insulating substrate with an interconnected array of electrical conductors upon its upper surface, and wherein each of said tiles contains a conductor or a pair of electrical conductors which make contact with corresponding conductors on said tray when said tile is placed thereon in any one of its possible locations and orientations, the positions of said conductor or conductors within said tiles being invisible to the players, and wherein each of said pieces contains an indicating device whose contacts can only be connected to the electrical conductors contained in any of said tiles when said piece is placed upon said tile in one unique orientation, thereby determining and indicating the direction of movement assigned to said tile when the electrical circuit comprising the tray, tiles and pieces is connected to a source of electrical power.

15. Apparatus according to claim 14 wherein each of said tiles is of regular polygonal form and said tray is symmetrical, and wherein said pieces are circular.

16. Apparatus according to claim 15 wherein said tray is square in form and each of said tiles is also square, the length of the side of said tray being a multiple of the length of the side of each tile, all tiles being of the same size, and wherein some or all of said tiles may be assigned a direction of movement parallel to one side, the remainder of said tiles being assigned a direction of movement along a diagonal, the total number of said tiles being sufficient to fill said tray.

17. Apparatus according to claim 15 wherein said tray is of regular hexagonal form and some of said tiles are triangular and some are hexagonal, the length of the sides of the triangular and hexagonal tiles being equal and the numbers of each type being sufficient to fill the tray in a regular array wherein hexagonal and triangular tiles are juxtaposed, the direction of movement assigned to each tile being normal to one side of said tile.

18. Apparatus according to claim 15 wherein said tray is of irregular hexagonal form and each of said tiles is an equilateral triangle, the direction of movement assigned to said tile being normal to one side.

19. Apparatus according to claim 15 wherein said tray is of hexagonal symmetry and each of said tiles is a regular hexagon, the direction of movement assigned to said tile being normal to one side.

20. Apparatus according to claim 1 wherein each of said tiles carries upon its face a number to be used for scoring purposes.

21. Apparatus according to claim 1 wherein each of said tiles carries upon its reverse face a letter or other symbol for use in a word game.

22. Apparatus according to claim 21 wherein each of said tiles further carries on its reverse face a number to be used for scoring purposes.

23. A method for playing a game using apparatus according to claim 1, wherein each of several players is assigned pieces of a particular color, and at the start of the game said tiles are arranged in said tray in a random manner so that the exact configuration of the directions of movement assigned to all of the tiles is not known to any of the players and can only be determined in play by placing pieces upon the tiles, and wherein each player in turn places at least one of his pieces upon the board at a specified starting location assigned to him and thereafter moves one piece at a time according to the rules of said game, including at some stage of the game a round of play in which each player may move his piece or one of his pieces to an adjacent tile in any direction he chooses, such a round of play being called a free move round and also including at some stage of the game a round of play in which each player must move his piece or one of his pieces according to the unique direction of movement assigned to the tile upon which it rests, such a round of play being called a forced move round, such free and forced move rounds of play alternating in some specified manner, and wherein each player attempts to move his pieces to a specified finishing location which may be the same for all players or may be different for each player, and subsidiary objectives of the game include the capture of opponents' pieces or constraining the opponent to move his pieces in less advantageous directions.

* * * * *